US006128904A

United States Patent [19]

Rosso, Jr. et al.

[11] Patent Number: 6,128,904

[45] Date of Patent: Oct. 10, 2000

[54] HYDRIDE-THERMOELECTRIC PNEUMATIC ACTUATION SYSTEM

[76] Inventors: Matthew J. Rosso, Jr., 197 Cupsaw Dr., Ringwood, N.J. 07456; Norman C. Allen, 1518 S. Fordham St., Perryton, Tex. 79070

[21] Appl. No.: 08/572,897

[22] Filed: Dec. 18, 1995

[51] Int. Cl.[7] ..... F01K 25/06

[52] U.S. Cl. ..... 60/649; 60/671

[58] Field of Search ..... 60/649, 671

[56] References Cited

U.S. PATENT DOCUMENTS

| | | | |
|---|---|---|---|
| 3,504,494 | 4/1970 | Winsche | 60/649 |
| 4,085,590 | 4/1978 | Powell et al. | 60/649 |
| 4,282,931 | 8/1981 | Golben | 169/61 |
| 4,377,209 | 3/1983 | Golben | 169/26 |
| 4,402,187 | 9/1983 | Golben et al. | 62/48 |
| 4,884,953 | 12/1989 | Golben | 417/379 |

*Primary Examiner*—Noah P. Kamen

[57] ABSTRACT

A device for storing and releasing hydrogen gas. The hydrogen gas can be used to drive pneumatic mechanical mechanisms. The hydrogen gas is stored in a metal hydride material. The metal hydride is in thermal contact with a thermoelectric module (10) (TEM). When acted upon by an electrical current through the TEM one volume of metal hydride (12) is heated and releases hydrogen gas while a second volume of metal hydride (28) is cooled and absorbs hydrogen gas. There is a pressure difference generated between the heated volume and the cooled volume. This difference in pressure is used to drive a pneumatic-mechanical mechanism to perform work.

2 Claims, 1 Drawing Sheet

HYDRIDE-THERMOELECTRIC PNEUMATIC ACTUATION SYSTEM

FIELD OF THE INVENTION

The invention described herein relates to a gas generating device that utilizes a metal hydride material that is energized or powered by an electrically driven thermoelectric module. The best use of this device is supplying and controlling hydrogen gas to a mechanical actuation system.

BACKGROUND—DESCRIPTION OF THE PRIOR ART

There are several means that have been employed to accomplish mechanical work by machines. Most of these can be classified into electromagnetic, electromechanical, hydraulic, or pneumatic means.

The electromagnetic devices utilize electrically generated magnetic fields interacting with highly permeable material moving elements to accomplish work. They have been successful in applications involving rapid mechanical response but tend to be non-linear in force application and present design complications for large displacement applications. They require large amounts of power from some external source, usually a sophisticated power conditioner/driver controller and they are noisy.

The electromechanical devices utilize an electric motor and frequently a gear train combination. Their most natural application is in those cases where rotary motions are suitable. This rotary motion character frequently drives the design considerations. In many cases at the output, rotary-to-linear mechanical conversion is necessary to satisfy the needed motion. Due to the numerous moving parts it is difficult to build an economical, and at the same time reliable and efficient, system using this class of device for most applications. They also tend to make excessive noise.

Hydraulic systems have found application where high force in combination with long linear motion is desired. These actuators require a complicated assortment of ancillary hardware such as electric or combustion engine motive means, fluid pumps, hoses/pipes, valves, and linear or rotary motion actuators. Due to very high internal operating pressures the components tend to be heavy. It is difficult to design these systems to operate efficiently. The closed circulation hydraulic working fluid tends to leak with attendant concern about failure, contamination and safety.

Current pneumatic systems have many of the features associated with their hydraulic cousins except that the working medium is a gas rather than a liquid. Prior art for supplying gas to pneumatic mechanical actuators is very similar to hydraulic systems in that they have also involved complicated arrangements of motors, pumps, valves and hoses to provide the working gas to the work output device. They too present hazards in operation.

It would be too exhaustive to review the vast scope of prior art in all the classes mentioned above. The new art in the present device is the use of metal hydride material in association with thermoelectric components to provide the motive means in close proximity to the pneumatic driven devices thereby eliminating the ancillary components. Nothing can be found in existing patents that show thermoelectric components being used with metal hydrides. The physical and thermal properties of hydrides are the most important component in the present invention, so research of prior art will focus on hydride materials and their application. There are several inventions that utilize metal hydride materials in association with heat. Five of these will be discussed to give the reader insight into prior art involving metal hydride materials. The first will be a fire extinguisher nozzle actuation concept. The second will be the application of metal hydrides to a solar powered water pump. The third will be hydrogen compressors. Two involve converting low grade heat to high grade heat to perform work external to the system.

In U.S. Pat. No. 4,377,209 to P. M. Golben, dated Mar 22, 1983, a hazardous building fire activates an alarm element that contains hydride material which releases hydrogen gas. This gas then motivates a piston connected to a piercing element that triggers another gas supply which dispenses fire suppressant. This application relies on heat energy, from a fire in the monitored space, to heat the metal hydride in the fire monitoring element to affect release of hydrogen and subsequent motivation of the piston to activate the fire extinguishing system. This design does not provide or require a high degree of control in that it relies on the fire to be extinguished and the element cooled down so the metal hydride can reabsorb the hydrogen and reset the trigger piston. This is a specific application to fire detection and suppression devices.

U.S. Pat. No. 4,282,931 to P.M. Golben dated Aug. 11, 1981 describes a metal hydride source which is activated by a resistance heater which is powered by an external source of electricity and is made of a specific material and design embodiment but it does not contain several important features of the present invention such as heat energy control which our invention provides with a thermoelectric module nor does it utilize opposed acting gas generating elements. The patent to Golben does not address the needs of overall efficiency when operating in conjunction with an external reciprocating working system.

U.S. Pat. No. 4,884,953 to P. M. Golben dated Dec. 5, 1989 describes a solar powered pump with electrical generator which utilizes the temperature difference between heat obtained from solar energy collection panels and pumped ground water to operate the pump unit. This patent teaches how to apply the unique properties of metal hydrides to efficiently operate a ground water pumping system. Another novel feature of this patent is use of the work being done by the metal hydride engine to additionally operate an electrical generator and storage unit which is used to operate the controls for the water flow so the system will work. This use of metal hydrides is in the construction of a low temperature heat engine and does not utilize thermoelectric elements.

U.S. Pat. No. 4,402,187 dated Sep. 6, 1983 to P. M. Golben and M. J. Rosso, Jr. describes a hydrogen gas compressor concept that utilizes the unique properties of metal hydrides to compress hydrogen without mechanical moving parts. It does not involve thermoelectrics in any way.

U.S. Pat. No. 3,504,494 dated Apr. 7, 1968 to W. E. Winche describes a method of using metal hydrides to intermittently provide heat pulses sufficient to generate steam which can then be used to perform work. The focus of this invention provides a technique to charge a metal hydride bed with energy which, when released during a shortened duty-cycle, can boil water and produce steam which can perform work in a dynamo, mechanical device, radiator, etc. where some of the energy is extracted from the steam. After performing this work the system is required to reject heat to ambient environment, condense the steam to water, and store the water while the low grade heat source recharges the initial metal hydride bed. This invention utilizes two metal hydride beds sharing the same volume of hydrogen gas to transform low grade heat to high grade heat in order to generate steam which is then used to perform work intermittently. The method of obtaining a higher temperature $T_1$ in the first bed 2 than $T_2$ in the second bed 4, both of which are above ambient temperature, is not disclosed in the text of the patent. This invention requires the use of numerous valves, tanks, heat exchangers etc. and would require a fairly sophisticated controller unit to operate the valving sequence. The system shown also relies on gravity to recharge the boiler feed tank for its proposed operation to generate steam as a primary working fluid. Our invention uses two separate gas volumes, whose temperature is controlled by a thermoelectric unit, and uses the hydrogen gas as the working fluid to actuate the mechanical work element directly.

U.S. Pat. No. 4,085,590 dated Apr. 25, 1978 to Powell et. al. incorporates and improves on Winche, by eliminating the water and steam generation for a secondary working fluid, and it also elaborates on specific design features of a metal hydride containment unit to be used for hydrogen compression (FIG. 2). The object of the invention is to produce high energy hydrogen gas working fluid power for directly driving turbine generator units from a low energy heat source but on a more continuous basis than Winche. The plurality of hydride beds and the complexity of the system that Powell proposes is much greater than Winche due to the large number of valves, pumps, heat exchangers, piping and fans needed for cycling the cross-fed hydride beds and imputing and rejecting heat energy from the system. As in Winche, the proposed system uses only one volume of hydrogen working gas. Our invention uses a thermoelectric unit to simultaneously input and extract heat from two separate hydrogen generators. This provides high efficiency operation. By reversing current in the thermoelectric unit rapid reversal of force can be achieved in the attached pneumatic mechanical device.

SUMMARY OF THE INVENTION

The invention uses a thermoelectric module coated with metal hydride material on either side. Each side communicates to one side of a double acting piston. The piston divides a cylinder into two chambers. Each chamber is filled with hydrogen gas. An electric control system applies current to the module which results in one side becoming cold and the other side becoming hot. The metal hydride that is cooled will absorb hydrogen hence lowering the pressure in one chamber while the metal hydride that is heated will release hydrogen causing the pressure to increase in the other chamber. The pressure differential in the chambers will cause the piston to move into the cooled chamber and perform work. In like manner, reversing the current will cause the piston to move in the opposite direction.

Accordingly, several objects and advantages of our invention are:

(a) to provide a hydrogen working gas source that is compact (b) to provide a hydrogen working gas source that is efficient (c) to provide a hydrogen working gas source that is light weight (d) to provide a hydrogen working gas source that is reliable (e) to provide a hydrogen driven pneumatic working system that eliminates the need for electrical motor, internal combustion or other rotary motive means (f) to provide a hydrogen driven pneumatic working system that eliminates the need for pumps, fans, compressors, compressed gas storage containers or other working media motive means.

(g) to provide a hydrogen driven pneumatic working system that eliminates the need for valves and valve operating devices for controlling working media flow.

(h) to provide a hydrogen driven pneumatic working system that does not require atmospheric air as a working medium; i.e., it operates in a sealed closed loop.

(i) to provide a hydrogen driven pneumatic working system that can be controlled by electrical current.

DRAWING FIGURES

Figure 1:
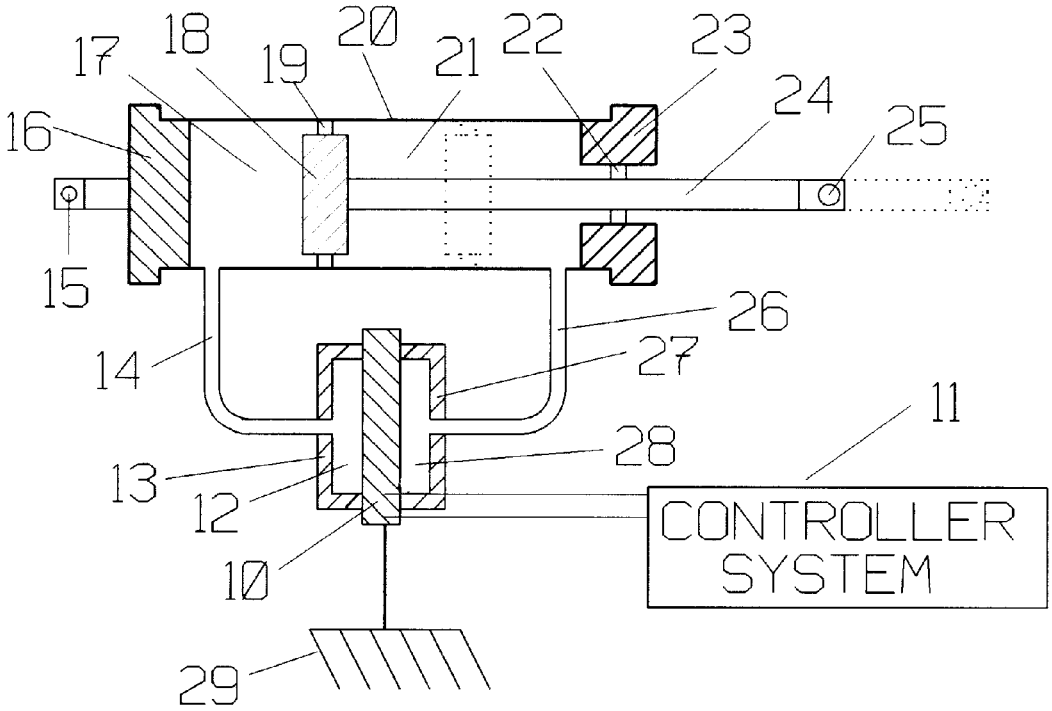
FIG. 1 shows a basic pneumatic metal hydride working system with a thermoelectric module, its electrical current control and an external mechanical motive device.

Reference Numerals in Drawings:

10 thermoelectric module (TEM)
11 controller system
12 metal hydride #1
13 gas generator #1
14 gas line #1
15 attach point #1
16 cylinder end cap #1
17 volume #1
18 movable piston
19 piston seal
20 cylinder
21 volume #2
22 piston rod seal
23 cylinder end cap #2
24 movable piston rod
25 attach point #2
26 gas line #2
27 gas generator #2
28 metal hydride #2
29 residual heat dissipation means
30 metal hydride containment filter
31 metal hydride chamber wall

Figure 2:
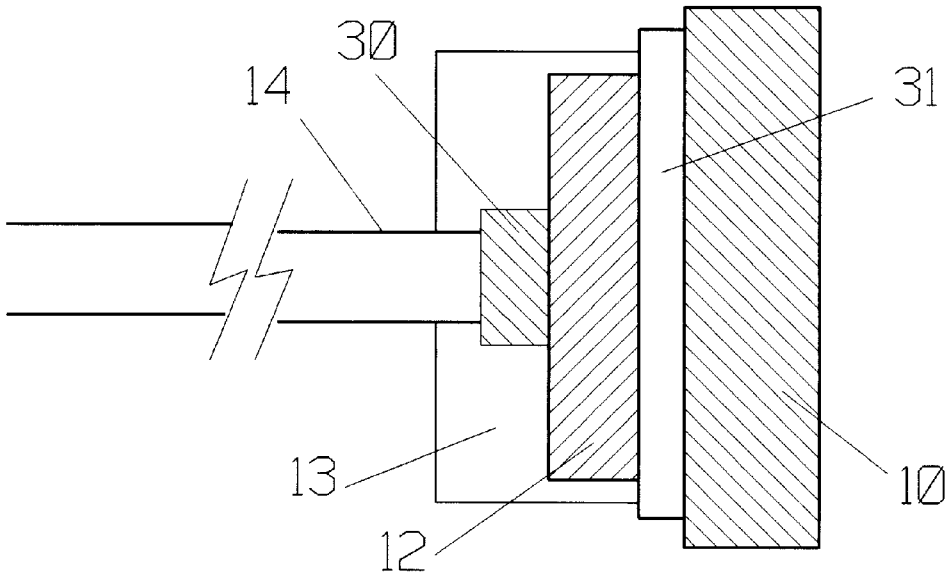
FIG. 2 shows details of a representative metal hydride containing volume.

DESCRIPTION—FIGS. 1 and 2

A preferred embodiment of the present invention is shown in FIG. 1 which shows a thermoelectric module (TEM) 10, operated by an electrical controller system 11. Different gas generating assemblies are shown on each of the two faces of the TEM. One of the gas generator assemblies is 13 and the second gas generator assembly is 27. Each of the gas generators consist of metal hydride material in a containment structure. The containment structures 13 and 27 are constructed of material impermeable to hydrogen and configured so that hydrogen gas can flow through piping to a double acting pneumatic cylinder or similar device. A metal hydride volume 12 is shown in contact with one face of the TEM. In a typical operational cycle of the working system, electrical current is supplied to the TEM which causes that surface to heat up. The heat drives hydrogen out of the metal hydride 12 encased in gas generator 13. The hydrogen vents out and through the gas line 14, through the wall of the cylinder 20, which has an end cap 16, and into cylinder volume 17 . The pressure built up in volume 17 motivates the movable piston 18 and the attached movable piston rod 24 to move, thereby expending work on an outside mechanism through attach point 25 on the piston rod. This displaced piston position is shown by the dotted lines in FIG. 1. A piston seal 19 prevents hydrogen gas from passing into the opposed second cylinder volume 21. The second cylinder volume 21 also contains a separate and independent supply of hydrogen gas. The hydrogen gas in volume 21 may pass through the cylinder wall, which is contained by the second end cap 23, through a second gas line 26, which goes to a second gas generator 27 containing a second metal hydride material 28. This second metal hydride material is in thermal contact with the cold face of the TEM 10. The cool metal hydride is disposed to absorb hydrogen and thereby develops reduced hydrogen gas pressure on the second cylinder volume 21. By, design selection of metal hydride material formulation in volumes 13 and 27, the differential pressures across the piston 18 can be determined in response to the temperature differential across the TEM. The result is that a force is exerted on the movable piston rod. When the rod moves, work is performed on the external mechanism connected to the piston rod.

The use of a thermoelectric (Peltier) device provides for very efficient use of electrical power to operate this system. Because of heat losses in the thermoelectric module a means must be provided to extract this residual heat which is schematically shown as a residual heat dissipation means 29. This heat extraction will be determined by application design considerations.

FIG. 2 shows a cross section view of a gas generator. The TEM 10 mentioned above is shown in contact with the metal hydride chamber 12 end wall 31. In practice this element may not exist as a separate component but be an integral structure with the TEM face plate (TEM's are commercially sold with electrically insulating headers which must be thermally interfaced with the application. In an improved thermal design this header would be integral with the gas generator structural component.). The metal hydride material is an extremely fine powder so that a large surface area is available for absorption and desorption of hydrogen gas. A particulate containment filter 30 is utilized so that hydride is retained in the generating chamber in close thermal contact with the TEM. A hydrogen gas purifier or "scrubber" (not shown) may also be included in the gas line to prolong the useful life of the hydride against contamination.

THEORY OF OPERATION

The important elements of this pneumatic actuator are metal hydrides used to absorb and desorb hydrogen gas and the TEM which provides heating and cooling of the hydrides. This section contains a brief description of the theory of operation of these two classes of devices and explains their importance to the present invention.

a. Operation of Metal Hydrides 12 and 28

Hydrogen gas shows a propensity to dissociate from its molecular form into its ionic form and "dissolve" into metal and metal alloys to a greater or lessor extent. In this reaction, hydrogen is acting as a metal. Alloys that can hold large amounts of hydrogen are called "metal hydrides" and encompass hydrides of the Groups III through VIII transition metals, including the rare earth and actinide series. There are other chemical series that can form hydrides but will not be discussed here. This is a very interesting class of material in that the hydrogen desorption-absorption properties with respect to temperature and pressure can be engineered by stoichiometry and preparation methods. As indicated above these metal alloys may contain several metals. Hydrogen seems to be able to effortlessly (i.e. efficiently) enter the compounds of many of these alloys. This process is reversible. The exact nature of this process is still under study but their gross engineering properties are our concern in the present application where our interest is in utilizing them as a cyclical hydrogen storage and source material. There is extensive technical literature describing these materials. A very good review is contained in Y. Yurum, ed.: *Hydrogen Energy System, Utilization of Hydrogen and Future Aspects*, NATO ASI series, Kluwer Publishing, The Netherlands, 1994 (in press) and Y. Fukai: *The Metal-Hydrogen System*, Springer, Berlin, 1993.

It has been found that the diffusion of the hydrogen into the lattice structure of the metal alloy depends on the ambient temperature and pressure. A pressure-composition isotherm line can be measured for any given alloy. A selection is made by material formulation and preparation methods so that this isotherm is in the range of ambient temperature in which the system will be expected to operate. Other considerations in the design are the hydrogen capacity, hysteresis, plateau pressure, and plateau slope of the fully activated alloy. When this alloy is heated it liberates its hydrogen at a rate depending upon the rate of heating. This hydrogen can be used to pressurize a device that is connectively attached to the volume containing the hydride. And it, if properly designed, can perform work. Conversely, if the hydride is cooled, is can absorb hydrogen and in the process perform work. The rate of absorption depends upon the rate of heat removal. This invention utilizes the properties of the hydride materials to perform in a complementary way with the TEM operation, to maximize performance of work by utilizing pressure on one volume, of an attached pneumatic-mechanical mechanism, and create a vacuum on the opposed second volume of the device.

b. Operation of the Thermoelectric module 10

If a junction is formed between two dissimilar metals and a current is caused to pass through the junction in one direction, heat is produced. When the direction of the current is reversed, cooling is produced. This phenomena is known as the Peltier effect. Some combination of metals show this effect more than others. There has been extensive commercial development of devices utilizing this effect in the past few years by material selection and fabricating methods. One popular configuration has many metal junctions constructed in parallel such that they share a common surface to be cooled. The other end of these junctions are constructed such that they are on another surface which is heated. This arrangement is called a "stage". If one attempts to generate great differential temperature with one stage of cooling, large power input is required and the efficiency of the process, referred to as "coefficient of performance", is reduced. However, these stages can be cascaded so that the hot junction of one can reject its heat to the cold junction of a second. Doing this produces improved efficiency for large temperature differences. In practice it is found that there must be a design trade-off between rate of heat pumping, difference of temperature between the heat input surface (cooled surface) and heat sink surface (heated surface), and the coefficient of performance of these devices in the specific application. In the present application, it is significant that we are using both surfaces of the TEM, the hot surface to heat metal hydride #1 12, and the cool surface to cool metal hydride #2 13. This fact further adds to the efficiency of the overall application of this invention. The theoretical design considerations of TEM's is beyond the scope of this presentation but can be found in the literature.

A good overview of thermoelectric devices can be found in D. M. Rowe and C. M. Bhondari: *Modern Thermoelectrics*, Reston Publishing Co. Inc., Reston, Va, 1983 and some recent technical papers can be found in B.

Mathiprakasaam, ed.; American Institute of Physics Conference Proceedings 316; *Thirteenth International Conference of Thermoelectrics*, 1994.

SCOPE OF THE INVENTION

Accordingly, the reader will see that the hydride-thermoelectric pneumatic actuation system is able to provide efficient performance in a small, light-weight, closed circulation unit which can be directly controlled by electric current; thereby, saving system complications and extensive use of ancillary hardware to accomplish mechanical work. In addition to safety, reliability and contamination improvements, these units can be economically manufactured.

Although the description of the system is based on a specific configuration (the cylinder and piston depicted in FIG. 1) this should not limit the application of the principles taught. There are many design approaches in size, shape, materials, etc. that can be successfully reduced to practice using this invention. Some potential design embodiments that may be adopted are:

(a) The mating surfaces of the TEM need not be flat (b) The end plates of the TEM may contain the hydride materials to achieve improved thermal contact and heat transfer (c) The pneumatic cylinder and piston actuator shown in FIG. 1 is typical, but any volume or pressure responsive mechanism (e.g., bladders, bellows, diaphragms etc.) may be used successfully as long as the application uses a material in contact with the hydrogen gas that is compatible.

(d) The concept can be applied in a variety of ambient pressures, humidities, ambient gaseous constituents, ambient fluid constituents, and thermal environments.

(e) There are many design and application adaptations that one skilled in the art might utilize in a specific embodiment. The following list identifies some of the features that are design specific as far as a particular application:

(1) Routing of gas lines.

(2) Configuration of hydrogen gas entries into and out of the working mechanism.

(3) Means of dissipating the residual heat from the TEM.

(4) Supplementary means of heating and coding the hydride gas generators (5) Seal (22) configuration for the working mechanical element(s).

(6) Seal lubricants and lubricant containment means used.

(7) Hydride containment geometry.

(8) Hydride containment screens and filters (if used).

(9) Hydrogen scrubbers or purifiers (if used).

(10) Hydride formulations (may be hydride material not containing a metal).

(11) Provisions for activating the hydride during assembly.

(12) Provisions for servicing or testing the unit after installation.

(13) Materials used in the construction of the gas generator.

(14) Electrical controller system (depends on the TEM-hydride combination and on the most efficient way to power the TEM)

(15) The number of pairs of gas generators on a TEM (and associated working mechanisms).

(16) The number of external pneumatic-mechanical devices on a gas generation pair.

(17) Connection of the working mechanism to an external system.

Thus the scope of the invention should be determined by the appended claims and their legal equivalents, rather than by the example given.

We claim:

1. A pneumatic actuation system comprising:

control means for supplying current to a thermoelectric module which has metal hydride on first and second faces, a double acting mechanical device defining a first chamber connected by a pipe to said first face and a second chamber connected by a pipe to said second face, said device has an output member for performing useful work separating said chambers, and hydrogen gas in said chambers which acts on both sides of said output member;

wherein when said control means supplies current in a first direction, one face will be cooled causing hydrogen to be absorbed by said metal hydride and reducing pressure in said connected chamber while at the same time the other face will be heated causing hydrogen to be released by said metal hydride and increasing pressure in said connected chamber, the pressure differential moving said output member, and wherein by reversing current will reverse the movement of the output member.

2. A pneumatic system as set forth in claim 1, wherein the metal hydride on the first face has a different formulation from the metal hydride on the second face.

* * * * *